US006015441A

United States Patent [19]

Brown et al.

[11] Patent Number: 6,015,441

[45] Date of Patent: Jan. 18, 2000

[54] FUEL COMPOSITION

[75] Inventors: Gerald Ivan Brown, Wantage; Kevin John Morton, Chippenham; Martin John Flannigan, Abingdon, all of United Kingdom

[73] Assignee: Exxon Chemical Patents, Inc., Linden, N.J.

[21] Appl. No.: 08/930,399

[22] PCT Filed: Apr. 23, 1996

[86] PCT No.: PCT/EP96/01728

§ 371 Date: Sep. 30, 1997

§ 102(e) Date: Sep. 30, 1997

[87] PCT Pub. No.: WO96/34073

PCT Pub. Date: Oct. 31, 1996

[30] Foreign Application Priority Data

Apr. 28, 1995 [GB] United Kingdom ..... 9508644

[51] Int. Cl.[7] ..... C10L 1/18

[52] U.S. Cl. ..... 44/393; 44/395

[58] Field of Search ..... 44/395, 393

[56] References Cited

U.S. PATENT DOCUMENTS

| | | |
|---|---|---|
| 3,048,479 | 8/1962 | Ilnyckyj et al. . |
| 3,961,916 | 6/1976 | Ilnyckyj et al. . |
| 4,211,534 | 7/1980 | Feldman . |
| 4,375,973 | 3/1983 | Rossi et al. . |
| 4,402,708 | 9/1983 | Opwald . |
| 4,464,182 | 8/1984 | Jack et al. . |
| 4,491,455 | 1/1985 | Ishizaki et al. . |

FOREIGN PATENT DOCUMENTS

| | | |
|---|---|---|
| 0061895 | 6/1982 | European Pat. Off. . |
| 0301837 | 1/1989 | European Pat. Off. . |
| 0445844 | 11/1991 | European Pat. Off. . |
| 0017159 | 4/1994 | WIPO . |
| 0000386 | 6/1994 | WIPO . |
| 0000536 | 6/1994 | WIPO . |
| 0000537 | 6/1994 | WIPO . |

*Primary Examiner*—Margaret Medley
*Attorney, Agent, or Firm*—Ohlandt, Greeley, Ruggiero & Perle

[57] ABSTRACT

A fuel oil composition comprising: (A) a major proportion of a middle distillate petroleum fuel having a wax content of less than 2 wt % at 10° C. below the wax appearance point of the fuel, and either: (i) a final boiling point of greater than 355° C. and either a (90–20%) distillation range of greater than 115 ° C. or a (FBP-90%) distillation range of 30° C. or greater; or (ii) a final boiling point of greater than 360° C. and either a (90–20%) distillation range of greater than 110° C. or a (FBP-90%) distillation range of 25° C. or greater; or (iii) a final boiling point of greater than 370° C. and either a (90–20%) distillation range of greater than 100° C. or a (FBP-90%) distillation range of 250° C. or greater), and (B) a minor proportion of an additive comprising: (B1) an ethylene-unsaturated ester copolymer flow improver, other than an ethylene-vinyl acetate bipolymer, the flow improver having an unsaturated ester content of greater than 10 mole %; and, optionally, (B2) an ethylene-unsaturated ester copolymer that is different from (B1).

17 Claims, No Drawings

FUEL COMPOSITION

This application is a 371 of PCT/EP96/01728 filed on Apr. 23, 1996.

This invention relates to fuel compositions.

BACKGROUND OF THE INVENTION

Petroleum distillates such as diesel oil or fuel oil contain, depending on their sources and distillation conditions, normal paraffins which in certain latitudes in winter precipitate as waxy crystals at low temperatures. As the temperature in the oil fails, the crystals tend to grow into large platelets and their presence eventually increases the viscosity of the fuel to an extent that it can no longer be poured (pour point). In the 1960's, ethylene/vinyl acetate copolymers (EVA), such as described in U.S. Pat. No. 3,093,623 and U.S. Pat. No. 3,048,479 were used commercially as additives for lowering the pour point of the oils at fairly low temperatures. The pour point is however some degrees below the temperature at which the wax crystals begin to appear (known as the cloud point) and so the fuel will still pour despite the presence of some wax crystals.

It was also found that depression of the pour point was not the only decisive factor for the winter time handling of paraffin-containing petroleum distillates. Specifically, it was found that at temperatures between the cloud point and the pour point, large wax crystals could sometimes form which could prevent the oil passing through filters despite its ability to pour. To measure this filter plugging tendency, the Cold Filter Plugging Point (CFPP) test was developed and became a European standard. It was found that petroleum middle distillates could more readily be conveyed through pumps and filters, with less danger of blockages occurring due to precipitates of waxy paraffin crystals, by use of suitable additives to hold the crystal growth within such limits that only small crystals precipitated. Such suitable additives were also based on ethylene/vinyl acetate copolymers. These show the surprising effect of not only depressing the pour point, but also substantially restricting the growth in size of the paraffin crystals. This is due to the EVA having a low degree of branching of 6 or fewer methyl side chains, thereby giving an improvement in the CFPP performance of the oil.

However, it has now been found that, in certain fuels, ethylene-vinyl acetate copolymers give unacceptable variation in CFPP results due to randomly occurring aspiration anomalies in carrying out the test. Thus, the refiner may not be able to reliably treat the fuel or may have to treat the fuel with higher additive concentrations than should be necessary.

More specifically, fuel oil compositions being middle distillate petroleum-based fuel oils treated with ethylene-vinyl acetate flow improvers are typically produced to meet a specified target for CFPP performance (referred to herein as the 'CFPP Specification'), which is determined by measurement in the CFPP test. Aspiration anomalies give rise to variable results in the test, making the task of accurately determining CFPP performance difficult and giving rise to doubts over whether the fuel oil composition meets its CFPP Specification. These aspiration anomalies have been observed particularly when untreated fuel oils having the following characteristics are used as the base fuel in such compositions;

a wax content of less than 2 wt % at 10° C. below wax appearance temperature, and either (i) a final boiling point of greater than 355° C.; and either a (90–20%) distillation range of greater than 115° C. or a (FBP-90%) distillation range of 30° C. or greater, or (ii) a final boiling point of greater than 360° C.; and either a (90–20%) distillation range of greater than 110° C. or a (FBP-90%) distillation range of 25° C. or greater, or (iii) a final boiling point of greater than 370° C.; and either a (90–20%) distillation range of greater than 100° C. or a (FBP-90%) distillation range of 25° C. or greater, all temperatures being measured in accordance with ASTM D-86.

It has been found that this aspiration problem may be overcome by the addition of higher levels of the ethylene-vinyl acetate copolymers in these critical base fuel oils, to the point where the incidence of aspirations becomes negligible. However, this results in the use of excessive amounts of the copolymers and does not represent an economical way of obtaining fuel oil compositions reliably meeting their CFPP Specification.

It has now been discovered that treating the above-defined critical base fuel oils with certain other ethylene vinyl ester copolymer flow improvers leads to specific fuel oil compositions which are less prone to aspirations and which have comparable or even improved CFPP potency. As a result, the fuel producer may produce fuels reliably meeting the required CFPP Specification whilst using substantially less flow improver, so obtaining the desired fuel oil compositions more economically and consistently.

SUMMARY OF THE INVENTION

Thus, a first aspect of the invention is a fuel oil composition comprising (A) a major proportion of a middle distillate petroleum-based fuel oil having a wax content of less than 2 wt % at 10° C. below the wax appearance temperature of the fuel, and either (i) a final boiling point of greater than 355° C.; and either a (90–20%) distillation range of greater than 115° C. or a (FBP-90%) distillation range of 30° C. or greater; or (ii) a final boiling point of greater than 360° C.; and either a (90–20%) distillation range of greater than 110° C. or a (FBP-90%) distillation range of 25° C. or greater; or (iii) a final boiling point of greater than 370° C.; and either a (90–20%) distillation range of greater than 100° C. or a (FBP-90%) distillation range of 250° C. or greater, all temperatures being measured in accordance with ASTM D-86, and (B) a minor proportion of an additive comprising (B1) an ethylene-unsaturated ester copolymer flow improver, other than an ethylene-vinyl acetate bipolymer, the flow improver having an unsaturated ester content of greater than 10 mole %; and, optionally, (B2) an ethylene-unsaturated ester copolymer that is different from (B1).

A second aspect of the invention is use of additive (B), as defined above, in fuel oil (A), as defined above, to provide a fuel oil composition reliably meeting its required CFPP specification.

DETAILED DESCRIPTION OF THE PREFERRED EMBODIMENT

Features of the invention will now be discussed in further detail as follows:

ADDITIVE (B1): Ethylene unsaturated ester copolymer flow improvers have a polymethylene backbone divided into segments by hydrocarbyl side chains interrupted by one or more oxygen atoms and/or carbonyl groups.

More especially, the copolymer may comprise an ethylene copolymer having, in addition to units derived from ethylene, units of the formula $$—CR^5R^6—CHR^7—$$

wherein $R^6$ represents hydrogen or a methyl group; $R^5$ represents a $—OOCR^8$ or $—COOR^8$ group wherein $R^8$ represents hydrogen or a $C_1$ to $C_{28}$, preferably $C_1$ to $C_{16}$, more preferably $C_1$, to $C_9$, straight or branched chain alkyl group; most preferably $C_5$–$C_{28}$, and $R^7$ represents hydrogen or a $—COOR^8$ or $—OOCR^8$ group, provided that the copolymer is not an ethylene-vinyl acetate bipolymer.

These may comprise a copolymer of ethylene with an ethylenically unsaturated ester, or derivatives thereof. An example is a copolymer of ethylene with an ester of an unsaturated carboxylic acid such as ethylene - acrylates (e.g. ethylene -2ethylhexylacrylate), but the ester is preferably one of an unsaturated alcohol with a saturated carboxylic acid such as described in GB-A-1,263,152. An ethylene/vinyl ester copolymer is advantageous; ethylene vinyl propionate, ethylene-vinyl hexanoate, ethylene 2-ethylhexanoate, or ethylene-vinyl octanoate copolymer is preferred. Preferably, the copolymers contain from greater than 10 to 25 such as less than 25, e.g. up to 20 such as 11 to 20, mole % of the unsaturated ester, more preferably from greater than 10 to 15 such as 11 to 15 mole % unsaturated ester. Preferably, number average molecular weight, as measured by vapour phase osmometry, of the copolymer is 1,000 to 10,000, more preferably 1,000 to 5,000. If desired, the copolymers may be derived from additional comonomers, e.g. they may be terpolymers or tetrapolymers or higher polymers, for example where the additional comonomer is isobutylene or diisobutylene or another ester giving rise to different units of the above formula and wherein the above-mentioned mole %'s of ester relate to total ester. The mole % of unsaturated ester is believed to help control the incidence of aspirations observed with the critical oils.

Also, the copolymers may include small proportions of chain transfer agents and/or molecular weight modifiers (e.g. acetaldehyde or propionaldehyde) that may be used in the polymerisation process to make the copolymer.

The copolymers may be made by direct polymerisation of comonomers. Such copolymers may also be made by transesterification, or by hydrolysis and reesterification, of an ethylene unsaturated ester copolymer to give a different ethylene unsaturated ester copolymer. For example, ethylene vinyl hexanoate and ethylene vinyl octanoate copolymers may be made in this way, e.g. from an ethylene vinyl acetate copolymer.

The copolymers may, for example, have 15 or fewer, preferably 10 or fewer, more preferably 6 or fewer, most preferably 2 to 5, methyl terminating side branches per 100 methylene groups, as measured by nuclear magnetic resonance, other than methyl groups on a comonomer ester and other than terminal methyl groups.

The copolymers may have a polydispersity of 1 to 6 preferably 2 to 4, polydispersity being the ratio of weight average molecular weight to number average molecular weight both as measured by Gel Permeation Chromatography using polystyrene standards.

Preferred examples of terpolymers are ethylene terpolymers having, in addition to units derived from ethylene, units of the formula

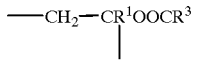

I and units of the formula

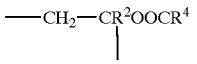

II wherein $R^1$ and $R^2$, which may be the same or different, each represent H or methyl, $R^3$ represents an alkyl group having up to 4 carbon atoms, and $R^4$ represents a linear or branched alkyl group having from 3 to 15 carbon atoms, $R^3$ and $R^4$ being different. Preferably, $R^4$ represents a branched chain alkyl group having from 8 to 15 carbon atoms, which may or may not be a tertiary alkyl group, or represents a branched chain alkyl group having at most 7 carbon atoms.

(B2): The optional ethylene-unsaturated ester polymers under (B2) may be defined as under (B1), but without the mole % unsaturated ester restriction and including ethylene-vinyl acetate bipolymers. Actually, ethylene-vinyl acetate bipolymers are preferred.

(B2) may comprise more than one polymer, e.g. where one polymer has an unsaturated ester content of 10 to 25 mole % and another polymer has an unsaturated ester content of less than 10 mole % such as 3.5 to 7 mole %.

CO-ADDITIVES

The aforementioned additives may be used in combination with one or more coadditives including one or more of the following:

Comb Polymers which are discussed in "Comb-Like Polymers. Structure and Properties", N. A. Plate and V. P. Shibaev, J. Poly. Sci. Macromolecular Revs., 8, p 117 to 253 (1974).

Generally, comb polymers consist of molecules in which long chain branches such as hydrocarbyl branches, optionally interrupted with one or more oxygen atoms and/or carbonyl groups, having from 6 to 30 such as 10 to 30, carbon atoms, are pendant from a polymer backbone, said branches being bonded directly or indirectly to the backbone. Examples of indirect bonding include bonding via interposed atoms or groups, which bonding can include covalent and/or electrovalent bonding such as in a salt. Generally, comb polymers are distinguished by having a minimum molar proportion of units containing such long chain branches.

Advantageously, the comb polymer is a homopolymer having, or a copolymer at least 25 and preferably at least 40, more preferably at least 50, molar per cent of the units of which have, side chains containing at least 6 such as at least 8, and preferably at least 10, atoms, selected from for example carbon, nitrogen and oxygen, in a linear chain or a chain containing a small amount of branching such as a single methyl branch.

Examples of comb polymers are described in EP-A-214,786; EP-A-213,879; EP-A-153,176; EP-A-153,177; EP-A-156,577; EP-A-225,688; WO 91/16407; EP-A-282,342; and WO 93/19106.

Linear Compounds which comprise a compound in which at least one substantially linear alkyl group having 10 to 30 carbon atoms is connected via an optional linking group that may be branched to a non-polymeric residue, such as an organic residue, to provide at least one linear chain of atoms that includes the carbon atoms of said alkyl groups and one or more non-terminal oxygen, sulphur and/or nitrogen atoms. The linking group may be polymeric.

By "substantially linear" is meant that the alkyl group is preferably straight chain, but that straight chain alkyl groups having a small degree of branching such as in the form of a single methyl group branch may be used.

Preferably, the compound has at least two of said alkyl groups when the linear chain may include the carbon atoms of more than one of said alkyl groups. When the compound has at least three of said alkyl groups, there may be more than one of such linear chains, which chains may overlap. The linear chain or chains may provide part of the linking group between any two such alkyl groups in the compound.

The oxygen atom or atoms, if present, are preferably directly interposed between carbon atoms in the chain and may, for example, be provided in the linking group, if present, in the form of a mono- or poly-oxyalkylene group, said oxyalkylene group preferably having 2 to 4 carbon atoms, examples being oxyethylene and oxypropylene.

Examples of linear compounds are described in EP-A-61,895; U.S. Pat. No. 4,491,455; JP 2-51477; JP 3-34790; EP-A-1 17,108; EP-A-326,356; and EP-A-356,256.

Polar Compounds

Such compounds comprise an oil-soluble polar nitrogen compound carrying one or more, preferably two or more, hydrocarbyl substituted amino or imino substituents, the hydrocarbyl group(s) being monovalent and containing 8 to 40 carbon atoms, which substituent or one or more of which substituents optionally being in the form of a cation derived therefrom. The oil-soluble polar nitrogen compound is either ionic or non-ionic and is capable of acting as a wax crystal growth modifier in fuels. Preferably, the hydrocarbyl group is linear or slightly linear, i.e. it may have one short length (1–4 carbon atoms) hydrocarbyl branch. When the substituent is amino, it may carry more than one said hydrocarbyl group, which may be the same or different.

The term "hydrocarbyl" refers to a group having a carbon atom directly attached to the rest of the molecule and having a hydrocarbon or predominantly hydrocarbon character. Examples include hydrocarbon groups, including aliphatic (e.g. alkyl or alkenyl), alicyclic (e.g. cycloalkyl or cycloalkenyl), aromatic, and alicyclicsubstituted aromatic, and aromatic-substituted aliphatic and alicyclic groups.

Aliphatic groups are advantageously saturated. These groups may contain nonhydrocarbon substituents provided their presence does not alter the predominantly hydrocarbon character of the group. Examples include keto, halo, hydroxy, nitro, cyano, alkoxy and acyl. If the hydrocarbyl group is substituted, a single (mono) substituent is preferred.

Examples of polar compounds are described in U.S. Pat. No. 4,211,534; EP-A-272,889: U.S. Pat. No. 4,147,520; EP-A-261,957; EP-A-316,108.

FUEL OIL

The fuel oil is obtained in refining crude oil as the fraction between the lighter kerosene and jet fuels fraction and the heavier fuel oil fraction. Examples are kerosene, jet fuels, diesel fuels, heating oils, and heavy fuel oils.

The wax appearance temperature of the fuel is as measured by Differential Scanning Calorimetry (DSC). Wax appearance temperature is a measure of the onset of crystallisation and hence the Cloud Point. Thus, a small sample (25 $\mu$l) of test fuel is cooled at 2° C./minute from a temperature at least 30° C. above the expected cloud point of the fuel. An exotherm is observed when crystallisation commences in the sample and the WAT is measured by an extrapolation technique using a Mettler TA2000B differential scanning calorimeter.

The distillation characteristics are as set forth in Designation D-86 of the American Society for Testing and Materials (ASTM).

TREAT RATES

The concentration of the additive in the oil may for example in the range of 1 to 5000 ppm of additive (active ingredient) by weight per weight of fuel, for example 10 to 5,000 ppm such as 10 to 2000 ppm (active ingredient) by weight per weight of fuel, preferably 25 to 500 ppm, more preferably 50 to 200 ppm, for example 60 to 90 ppm.

The additive or additives should be soluble in the oil to the extent of at least 1000 ppm by weight per weight of oil at ambient temperature. However, at least some of the additive may come out of solution near the cloud point of the oil in order to modify the wax crystals that form.

CONCENTRATES

Concentrates comprising the additive in admixture with a carrier liquid (e.g. as a solution or a dispersion) are convenient as a means for incorporating the additive into bulk oil such as distillate fuel, which incorporation may be done by methods known in the art. The concentrates may also contain other additives as required and preferably contain from 3 to 75 wt %, more preferably 3 to 60 wt %, most preferably 10 to 50 wt % of the additives preferably in solution in oil. Examples of carrier liquid are organic solvents including hydrocarbon solvents, for example petroleum fractions such as naphtha, kerosene, diesel and heater oil. aromatic hydrocarbons such as aromatic fractions, e.g. those sold under the 'SOLVESSO' tradename; and paraffinic hydrocarbons such as hexane and pentane and isoparaffins. The carrier liquid must, of course, be selected having regard to its compatibility with the additive and with the fuel.

The additives of the invention may be incorporated into bulk oil by other methods such as those known in the art. If co-additives are required, they may be incorporated into the bulk oil at the same time as the additives of the invention or at a different time.

OTHER CO-ADDITIVES

The additives of the invention may be used singly or as mixtures. They may also be used in combination with one or more co-additives such as known in the art, for example the following: detergents, antioxidants, corrosion inhibitors, dehazers, demulsifiers, metal deactivators, antifoaming agents, cetane improvers, cosolvents, package compatibilisers, reodorants, lubricity additives and antistatic additives.

EXAMPLES

The following examples illustrate the invention.

Materials Used

Additive Components

A1: an ethylene-vinyl acetate copolymer of number average molecular weight 5000 as measured by GPC (Gel Permeation Chromatography) against polystyrene standards and containing 13.5% by weight of vinyl acetate.

A2: an ethylene-vinyl acetate copolymer of number average molecular weight 3300 as measured by GPC and containing 36% by weight of vinyl acetate.

B: an ethylene-vinyl acetate—vinyl 2-ethyl hexanoate terpolymer, made by free radical copolymerisation of the comonomers, containing 4.0 mole % vinyl acetate, 11.1 mole % vinyl 2-ethyl hexanoate, balance ethylene, having an Mn of 4,200 (by GPC) and a $CH_3$/100 $CH_2$, not corrected for terminal methyl groups of 4.0, dissolved in a heavy aromatic naphtha solvent at 60% active ingredient dilution.

Formulations (all wt %)

X: 4.5% Al, 59% A2 and the remainder being solvent.

Y: 5% Al, 14.8% A2, 30.1 % B, the remainder being solvent.

Fuels

| | I | II |
|---|---|---|
| Cloud Point (° C.) | −1 | −3 |
| Wax (mass %) 10° C. below cloud point | 1.9 | 1.9 |
| D-86 (° C.) | | |
| IBP | 172 | 172 |
| 10% | 213 | 204 |
| 20% | 231 | 219 |
| 50% | 280 | 265 |
| 90% | 346 | 340 |
| 95% | 359 | 355 |
| FBP | 371 | 367 |
| 90%-20% | 115 | 121 |
| FBP-90% | 25 | 27 |

Test Method (Cold Filter Plugging Point (CFPP) Test)

The test which is carried out by the procedure described in detail in "Journal of the Institute of Petroleum", Volume 52, Number 510, June 1966, pp.173–285, and more recently in European Standard EN 116, is designed to correlate with the cold flow of a middle distillate in automotive diesels.

In brief, a sample of the oil to be tested (40 ml) is cooled in a bath which is maintained at about −34° C. to give non-linear cooling at about 1° C./min. Periodically (at each one degree centigrade starting from above the cloud point), the cooled oil tested for its ability to flow through a fine screen in a prescribed time period using a test device which is a pipette to whose lower end is attached an inverted funnel which is positioned below the surface of the oil to be tested. Stretched across the mouth of the funnel is a 350 mesh screen having an area defined by a 12 millimeter diameter. The periodic tests are each initiated by applying a vacuum to the upper end of the pipette whereby oil is drawn through the screen up into the pipette to a mark indicating 20 ml of oil. After each successful passage, the oil is returned immediately to the CFPP tube. The test is repeated with each one degree drop in temperature until the oil fails to fill the pipette within 60 seconds, the temperature at which failure occurs being reported as the CFPP temperature.

Test Procedure

Formulations X and Y were each dissolved in Fuels I and II at specified treat rates and the CFPP measured as described above.

Results

| | Fuel I | | | | | | | | |
|---|---|---|---|---|---|---|---|---|---|
| Treat Rate (ppm) | 75 | 100 | 125 | 150 | 175 | 200 | 225 | 250 | 300 |
| Formulation X | −5 | −7 | −13 (A) | −13 (A) | | −15 | | | |
| | | −6 | −6 | −10 (A) | −12 | −12 (A) | −16 | −17 | −17 |
| | | −6 | −6 | −13 | −14 | −16 | −18 | −18 | −16 |
| | | −6 | −9 (A) | −13 (A) | −13 (A) | −12 | −17 | −17 | −17 |
| | | −5 | −7 | −12 (A) | −16 | −14 | −15 | −16 | −18 |
| | | −5 | −6 | −13 (A) | −15 | −15 (A) | −15 | −15 | −15 |
| | | −5 | −7 | | | | | | |
| | | −6 | −11 | | | | | | |
| | | −6 | −6 | | | | | | |
| Formulation Y | −7 | −15 (A) | −15 | −16 | | −17 | | | |
| | | −10 (A) | −13 | −15 | −15 | −16 | | | |
| | | −10 (A) | −10 | −16 | −16 | −17 | | | |
| | | −8 | −13 | −14 | −16 | −14 | | | |
| | | −6 | −13 (A) | −16 | −16 | −17 | | | |
| | | −13 | −14 | −15 | | −16 | | | |
| | | −8 (A) | −16 | | | | | | |
| | | −11 (A) | −14 | | | | | | |
| | | −9 (A) | −15 | | | | | | |
| | | 100 | 125 | | | | | | |
| Additive B alone | | −6 | −17 | | | | | | |
| | | −7 | −18 | | | | | | |
| | | −10 (A) | −18 | | | | | | |
| | | −8 (A) | −18 | | | | | | |

| | Fuel II | | | | | | | |
|---|---|---|---|---|---|---|---|---|
| Treat Rate (ppm) | 0 | 50 | 75 | 100 | 125 | 150 | 175 | 200 |
| Formulation X | −3 | −7 | | −12 (A) | −16 (A) | −16 | −18 | −18 |
| | | −7 | | −14 (A) | −16 (A) | −17 | −18 | −18 |
| | | | | −7 | −15 | −13 | | −16 |
| | | | | −8 | −15 (A) | −15 | | −16 |
| | | | | −12 (A) | −15 | | −16 | |
| | | | | −14 (A) | −14 (A) | | −17 | |
| | | | | −15 (A) | −15 | | | |
| | | | | −16 | −17 (A) | | | |
| | | | | −14 (A) | −14 (A) | | | |
| | | | | −13 (A) | | | | |
| | | | | −13 (A) | | | | |
| | | | | −14 (A) | | | | |

-continued

| | | | |
|---|---|---|---|
| Formulation Y | −3 | −16 | −17 |
| | | −16 | −18 |
| | | −15 (A) | −17 |
| | | −16 | −16 |
| | | −14 | −15 |
| | | −12 | −16 |
| | | −16 | −17 |
| | | −16 | −15 |

N.B. (A) indicates irregularity in the aspiration time curve, i.e. a plot of time to fill the CFPP pipette vs. temperature, indicating an aspiration anomaly.

The results show that fuels containing formulation Y of the invention became free of aspirations at a much lower treat rate than fuels containing comparison formulation X. For example, in Fuel I aspirations are absent with Formulation Y at 150 ppm whilst with the comparative ethylene-vinyl acetate bipolymer formulation X, 225 ppm was required to provide a fuel composition giving reliable aspiration free results.

We claim:

1. A fuel composition meeting its CFPP specification and having a reduced tendency for aspiration comprising:

(A) a major proportion of a middle distillate petroleum fuel having a wax content of less than 2 wt % at 10° C. below the wax appearancee point of the fuel, and either (i) a final boiling point of greater than 355° C. and either a (90–20%) distillation range of greater than 115° C. or a (FBP-90) distillation range of 30° C. or greater; or (ii) a final boiling point of greater than 360° C., and either a (90–20%) distillation range of greater than 110° C. or a (FBP-90%) distillation range of 25° C. or greater; or (iii) a final boiling point of greater than 370° C. and either a (90–20%) distillation range of greater than 100° C. or a (FBP-90%) distillation range of 25° C. or greater, all temperatures being measured in accordance with ASTM D-86, and (B) a minor proportion of an additive comprising (B1) an ethylene-unsaturated ester copolymer flow improver wherein said ethylene-unsaturated ester copolymer comprises an ethylene copolymer having, in addition to units dervied from ethylene, units of the forumla:

$$—CR^5R^6—CHR^7—$$

wherein $R^6$ represents hydrogen or a methyl group; $R^5$ represents a —$OCOCR^8$ or —$COOR^8$ group wherein $R^8$ represents hydrogen or a $C_5$ or $C_{28}$, straight or branched chain alkyl group; and $R^7$ represents hydrogen or a —$COOR^8$ or —$OCOR^8$ group, the flow improver having an unsaturated ester content of 10 mole % or greater; and, optionally (B2) an ethylene-unsaturated ester copolymer that is different from (B1).

2. The composition of claim 1, wherein (B1) has an unsaturated ester content of 11 to 20 mole %.

3. The composition of claim 1 further comprising at least one additive selected from the group consisting of: detergents, antioxidants, corrosion inhibitors, dehazers, demulsifiers, metal deactivators, antifoaming agents, cetane improvers, cosolvents, package compatibilisers, reodorants, lubricity additives and antistatic additives.

4. The composition of claim 1 wherein said ethylene-unsaturated ester copolymer has a polymethylene backbone divided into segments by hydrocarbyl side chains interrupted by one or more oxygen atoms and/or carbonyl groups.

5. A fuel composition meeting its CFPP specification and having a reduced tendency for aspiration comprising:

(A) a middle distillate petroleum fuel having a wax content of less than 2 wt % at 10° C. below the wax appearance point of the fuel, and either (i) a final boiling point of greater than 355° C. and either a (90–20%) distillation range of greater than 115° C. or a (FBP-90%) distillation range of 30° C. or greater; or (ii) a final boiling point of greater than 360° C., and either a (90–20%) distillation range of greater than 110° C. or a (FBP-90%) distillation range of 25° C. or greater; or (iii) a final boiling point of greater than 370° C.; and either a (90–20%) distillation range of greater than 100° C. or a (FBP-90%) distillation range of 25° C. or greater, all temperatures being measured in accordance with ASTM D-86, and (B) about 1 to 5000 ppm (active ingredient) by weight per weight of petroleum fuel of an additive comprising (B1) an ethylene-unsaturated ester copolymer flow improver wherein said ethylene-unsaturated ester copolymer comprises an ethylene copolymer having, in addition to units derived from ethylene, units of the formula:

$$—CR^5R^6—CHR^7—$$

wherein $R^6$ represents hydrogen or a methyl group; $R^5$ represents a —$OCOCR^8$ or —$COOR^8$ group wherein $R^8$ represents hydrogen or a $C_5$ or $C_{28}$, straight or branched chain alkyl group; and $R^7$ represents hydrogen or a —$COOR^8$ or —$OCOR^8$ group, the flow improver having an unsaturated ester content of 10 to 25 mole % or greater; and optionally (B2) an ethylene-unsaturated ester copolymer that is different from (B1), wherein (B1) and (B2) copolymer each comprises an ethylene copolymer having, in addition to units derived from ethylene, units of the formula:

$$—CR^5R^6—CHR^7—$$

wherein $R^6$ represents hydrogen or a methyl group; $R^5$ represents a —$OOCR^8$ or —$COOR^8$ group wherein $R^8$ represents hydrogen or a $C_1$ or $C_{28}$, straight or branched chain alkyl group; and $R^7$ represents hydrogen or a —$COOR^8$ or —$OOCR^8$ group.

6. The composition of claim 1 wherein said ethylene-unsaturated ester copolymer of (B1) comprises between about 10 to 25 mole % of said unsaturated ester.

7. The composition of claim 1 wherein said ethylene-unsaturated ester copolymer has a number average molecular weight, as measured by vapor phase osmometry, in the range between about 1,000 to 10,000.

8. The composition of claim 1 wherein said ethylene-unsaturated ester copolymer has 15 or fewer methyl terminating side branches per 100 methylene groups, as measured by nuclear magnetic resonance, other than methyl groups on a comonomer ester and other than terminal methyl groups.

9. The composition of claim 1 wherein said ethylene-unsaturated ester copolymer has a polydispersity of between about 1 to 6, said polydispersity being the ratio of weight average molecular weight to number average molecular weight both as measured by Gel Permeation Chromatography using polystyrene standards.

10. The composition of claim 1 wherein said ethylene-unsaturated ester copolymer of (B2) comprises an ethylene copolymer having, in addition to units derived from ethylene, units of the formula:

$$—CR^5R^6—CHR^7—$$

wherein $R^6$ represents hydrogen or a methyl group; $R^5$ represents a $—OOCR^8$ or $—COOR^8$ group wherein $R^8$ represents hydrogen or a $C_1$ to $C_{28}$, straight or branched chain alkyl group; and $R^7$ represents hydrogen or a $—COOR^8$ or $—OOCR^8$ group.

11. The composition of claim 1 wherein said ethylene-unsaturated ester copolymer of (B2) is an ethylene-vinyl acetate bipolymer.

12. The composition of claim 1 wherein said ethylene-unsaturated ester copolymer of (B2) comprises an ethylene copolymer having more than one polymer, one polymer having an unsaturated ester content of between about 10 to 25 mole % and another polymer having an unsaturated ester content of less than 10 mole %.

13. The composition of claim 1 further comprising a comb polymer which consists of molecules in which long chain branches such as hydrocarbyl branches, optionally interrupted with one or more oxygen atoms and/or carbonyl groups, having from about 6 to 30 carbon atoms, arc pendant from a polymer backbone, said branches being bonded directly or indirectly to said backbone.

14. The composition of claim 1 further comprising a linear compound comprising at least one substantially linear alkyl group having between about 10 to 30 carbon atoms is connected via an optional linking group that may be branched to a non-polymeric residue to provide at least one linear chain of atoms that includes the carbon atoms of said alkyl groups and one or more non-terminal oxygen, sulfur and/or nitrogen atoms.

15. The composition of claim 1 further comprising a polar compound which comprises an oil-soluble polar nitrogen compound carrying one or more hydrocarbyl substituted amino or imino substituents, said hydrocarbyl group(s) being monovalent and containing 8 to 40 carbon atoms.

16. The composition of claim 1 wherein said fuel oil is selected from the group consisting of: kerosene, jet fuels, diesel fuels, heating oils, and heavy fuel oils.

17. The composition of claim 1 wherein said additive is added to said middle distillate petroleum-based fuel oil in the range between about 1 to 5,000 ppm.

* * * * *